US010555074B2

(12) United States Patent
Chen

(10) Patent No.: US 10,555,074 B2
(45) Date of Patent: Feb. 4, 2020

(54) FULL-RANGE SPEAKER WITH PHASE PLATE

(71) Applicant: Tymphany Acoustic Technology (Huizhou) Co., Ltd., Huizhou, Guangdong Province (CN)

(72) Inventor: Zhi Chen, Huizhou (CN)

(73) Assignee: TYMPHANY ACOUSTIC TECHNOLOGY (HUIZHOU) CO., LTD., Huizhou, Guangdong Province (CN)

( * ) Notice: Subject to any disclaimer, the term of this patent is extended or adjusted under 35 U.S.C. 154(b) by 0 days.

(21) Appl. No.: 16/404,157

(22) Filed: May 6, 2019

(65) Prior Publication Data

US 2019/0342655 A1 Nov. 7, 2019

(30) Foreign Application Priority Data

May 4, 2018 (CN) ..... 2018 2 0656519

(51) Int. Cl.

| | |
|---|---|
| ***H04R 1/34*** | (2006.01) |
| ***H04R 9/00*** | (2006.01) |
| ***H04R 9/06*** | (2006.01) |
| ***H04R 9/02*** | (2006.01) |

(52) U.S. Cl.

CPC ..... *H04R 1/347* (2013.01); *H04R 9/02* (2013.01); *H04R 9/06* (2013.01)

(58) Field of Classification Search

CPC . H04R 1/00; H04R 1/02; H04R 1/023; H04R 1/026; H04R 1/34; H04R 1/38; H04R 1/345; H04R 1/347; H04R 9/00; H04R 9/02; H04R 9/06; H04R 2201/02; H04R 2400/11

See application file for complete search history.

(56) References Cited

U.S. PATENT DOCUMENTS

| | | | | |
|---|---|---|---|---|
| 7,873,178 B2 * | 1/2011 | Steere | ..... | H04R 1/06 381/343 |
| 2018/0279027 A1 * | 9/2018 | Peace, Jr. | ..... | H04R 1/025 |

* cited by examiner

*Primary Examiner* — Thang V Tran

(74) *Attorney, Agent, or Firm* — Muncy, Geissler, Olds & Lowe, P.C.

(57) ABSTRACT

A full-range speaker with phase plate includes a speaker body disposed with a bracket above and a phase plate including a phase plane. The bracket is adapted to the phase panel. The phase panel is fixed above the bracket. The opposite corners of the phase panel are provided with protruding support ribs, and each of the support ribs meets with each other. By adding the phase plate, the phase may be adjusted to prevent standing waves, and the frequency response characteristics of the speaker may be effectively improved, so that the overall frequency response curve of the full-range speaker is improved at 6 kHz-18 kHz, thereby smoothing the overall frequency response curve of the full-range speaker.

4 Claims, 4 Drawing Sheets

FULL-RANGE SPEAKER WITH PHASE PLATE

CROSS REFERENCE TO RELATED APPLICATIONS

This application claims priority under 35 U.S.C. § 119 to Chinese Patent Application No. CN 201820656519.9, which was filed on May 4, 2018, and which is herein incorporated by reference.

TECHNICAL FIELD

The present invention relates to a speaker, in particular, to a full-range speaker with phase plate.

BACKGROUND

In order to control the height of the product and realize a larger voice coil design, the traditional full-range speaker does not use elastic waves in the product design, but injects magnetic fluid into the magnetic gap to ensure centering of the voice coil to achieve stability of the product. The carcass is often designed in the shape of a pan.

The frequency response curve of the traditional full-range speaker has obvious attenuation at 6 kHz-18 kHz, with the average sensitivity being lower than 1000 Hz. The prior art still has to solve the problem of how to improve the frequency response curve at 6 kHz-18 kHz, making the overall frequency response curve of the full-range speaker more smooth.

SUMMARY

In order to solve the above problems existing in the prior art, the present invention provides a full-range speaker with phase plate.

To achieve the above object, the present invention provides the following technical solutions.

According to an embodiment of the present invention, a full-range speaker with phase plate comprises a speaker body disposed with a bracket above and a phase plate including a phase panel, the bracket being adapted to the phase panel, the phase panel being fixed above the bracket; the opposite corners of the phase panel are provided with protruding support ribs, and each of the support ribs meets with each other.

Further, the phase panel and the bracket are fixed by screwing.

Further, the cross section of the support rib is curved.

Further, the phase panel is square.

Based on the above technical solutions, the technical effects obtained by the present invention are as follows. By adding the phase plate, the phase may be adjusted to prevent standing waves, and the frequency response characteristics of the speaker may be effectively improved, so that the overall frequency response curve of the full-range speaker is improved at 6 kHz-18 kHz, thereby smoothing the overall frequency response curve of the full-range speaker.

Figure 1:
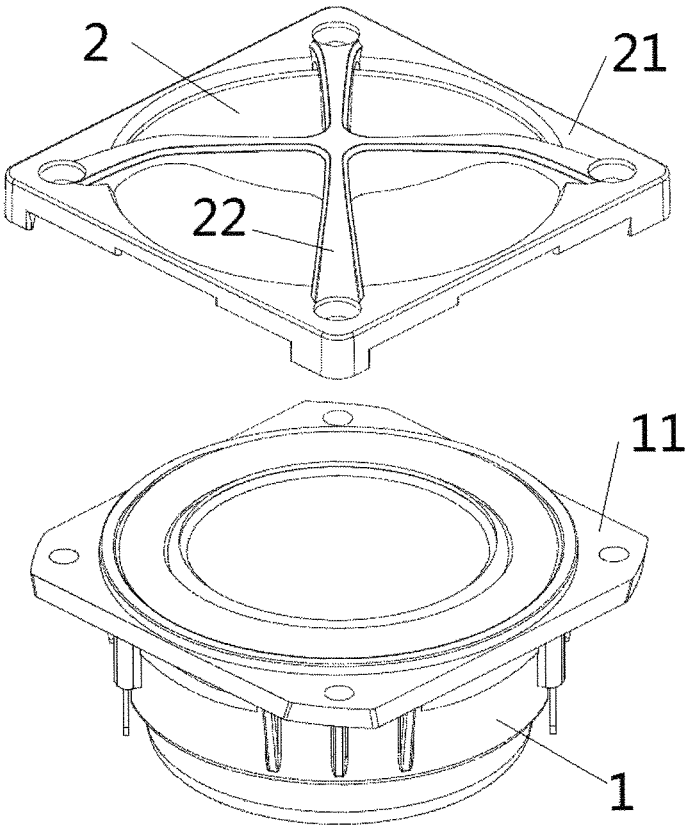
FIG. 1 is an exploded view showing the structural axis side of a full-range speaker with phase plate according to an exemplary embodiment of the invention.

Among those, the reference numerals are as follows:

1 speaker body;
2 phase plate;
11 bracket;
21 phase panel; and
22 support rib.

DETAILED DESCRIPTION

In order to facilitate the understanding of the present invention, the present invention will be described more fully hereinafter with reference to the accompanying drawings and specific embodiments. Preferred embodiments of the present invention are shown in the drawings. However, the present invention may be embodied in many different forms and is not limited to the embodiments described herein. Rather, these embodiments are provided so that this disclosure of the present invention will be more fully understood.

It should be noted that when an element is referred to as being "fixed" to another element, it can be directly on the other element or a center element can be present. When an element is referred to as being "connected" to another element, it can be directly connected to the other element or a center element can be present simultaneously.

For ease of reading, the terms "upper", "lower", "left", and "right" are used herein in the drawings to indicate the relative position of the reference between the elements, and not to limit the application.

All technical and scientific terms used herein, unless otherwise defined, have the same meaning as commonly understood by one of ordinary skill in the art to the present invention. The terminology used in the description of the present invention is for the purpose of describing particular embodiments and is not intended to limit the present invention.

Embodiment 1

Figure 2:
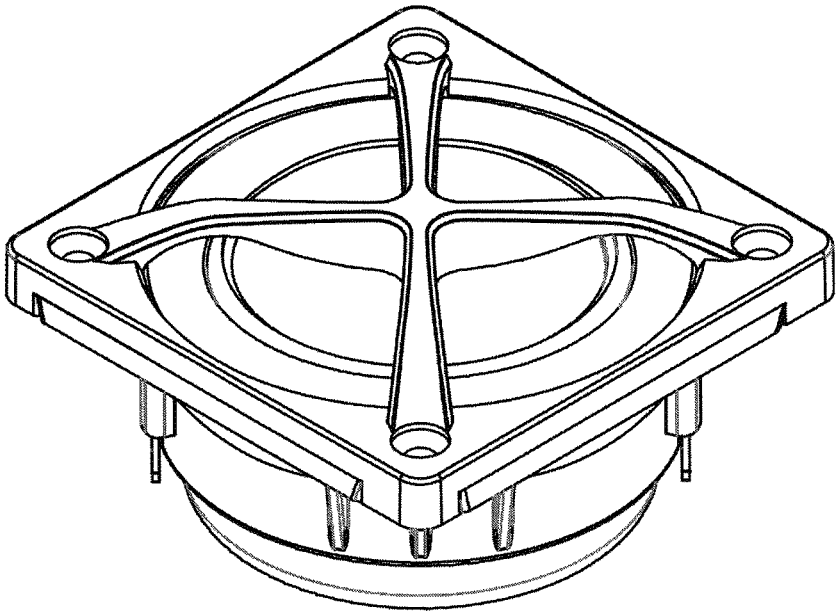
FIG. 2 is a structural axis side view of a full-range speaker with phase plate according to an exemplary embodiment of the invention.
Figure 3:
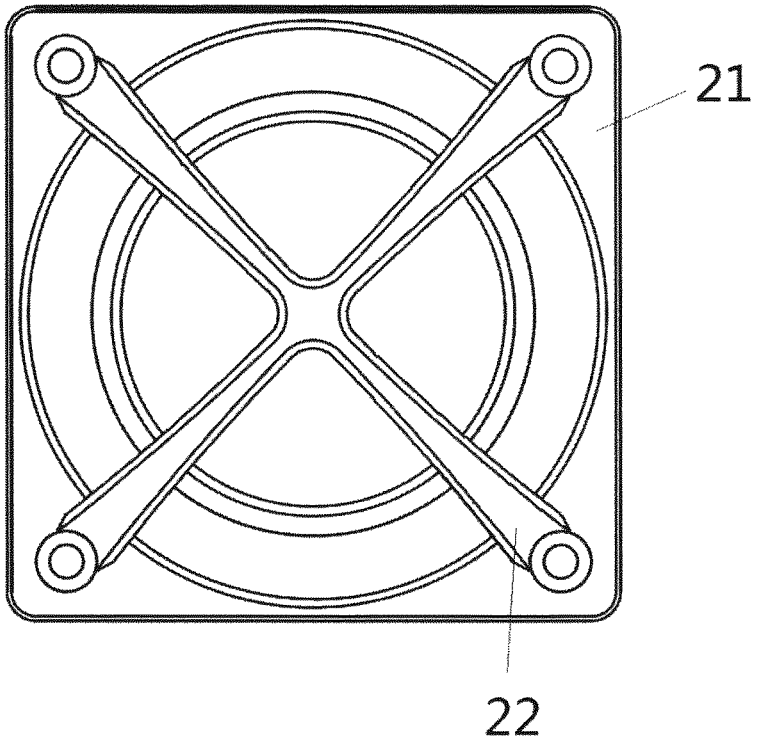
FIG. 3 is a top view of a full-range speaker with phase plate according to an exemplary embodiment of the invention.

FIGS. 1, 2, and 3 are respectively an exploded view of the structural axis side, a structural axis side view, and a top view of the full-range speaker with a phase plate according to an exemplary embodiment of the invention. As is illustrated in the figures, a full-range speaker with phase plate comprises a speaker body 1 and a phase plate 2. The speaker body 1 is disposed with a bracket 11 above. The phase plate 2 includes a phase panel 21 and a support rib 22. The bracket 11 is adapted to the phase panel 21 and the phase panel 21 is fixed above the bracket 11. The phase panel 21 is fixed to the bracket 11 by screwing. The opposite corners of the phase panel 21 are provided with protruding support ribs 22, and each of the support ribs 22 meets with each other.

Figure 4:
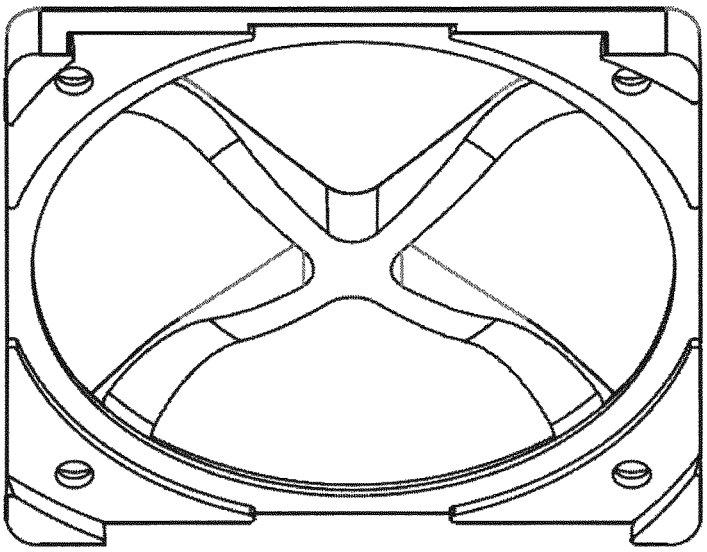
FIG. 4 is an axis side view of the phase plate of a full-range speaker with phase plate according to an exemplary embodiment of the invention.
Figure 5:
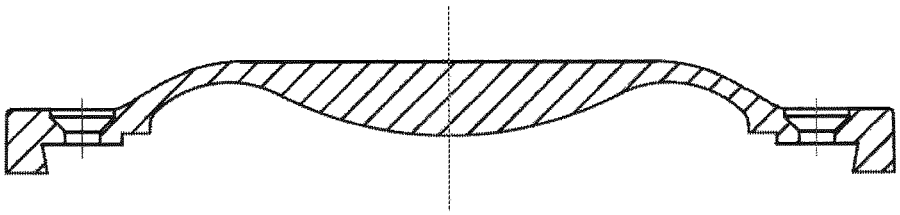
FIG. 5 is a sectional view of the support rib of the phase plate of a full-range speaker with phase plate according to an exemplary embodiment of the invention.

FIG. 4 is an axis side view of the phase plate of a full-range speaker with phase plate according to an exemplary embodiment of the invention and FIG. 5 is a sectional view of the support rib of the phase plate of a full-range speaker with phase plate. As shown in Figures, the cross section of the support rib 22 is curved, and in the present embodiment, the phase panel 21 is square.

In the present embodiment, a phase plate is added to the existing full-range speaker to adjust the phase and prevent standing waves for effectively improving the frequency response characteristics of the full-range speaker. At the same time, while ensuring the stability of the full-range speaker structure, the width of the support ribs 22 is as narrow as possible, and the height of the support ribs 22 is set to avoid the maximum mechanical stroke of the speaker diaphragm, so that the diaphragm is prevent from hitting the support ribs during the sounding of the speaker.

Figure 6:
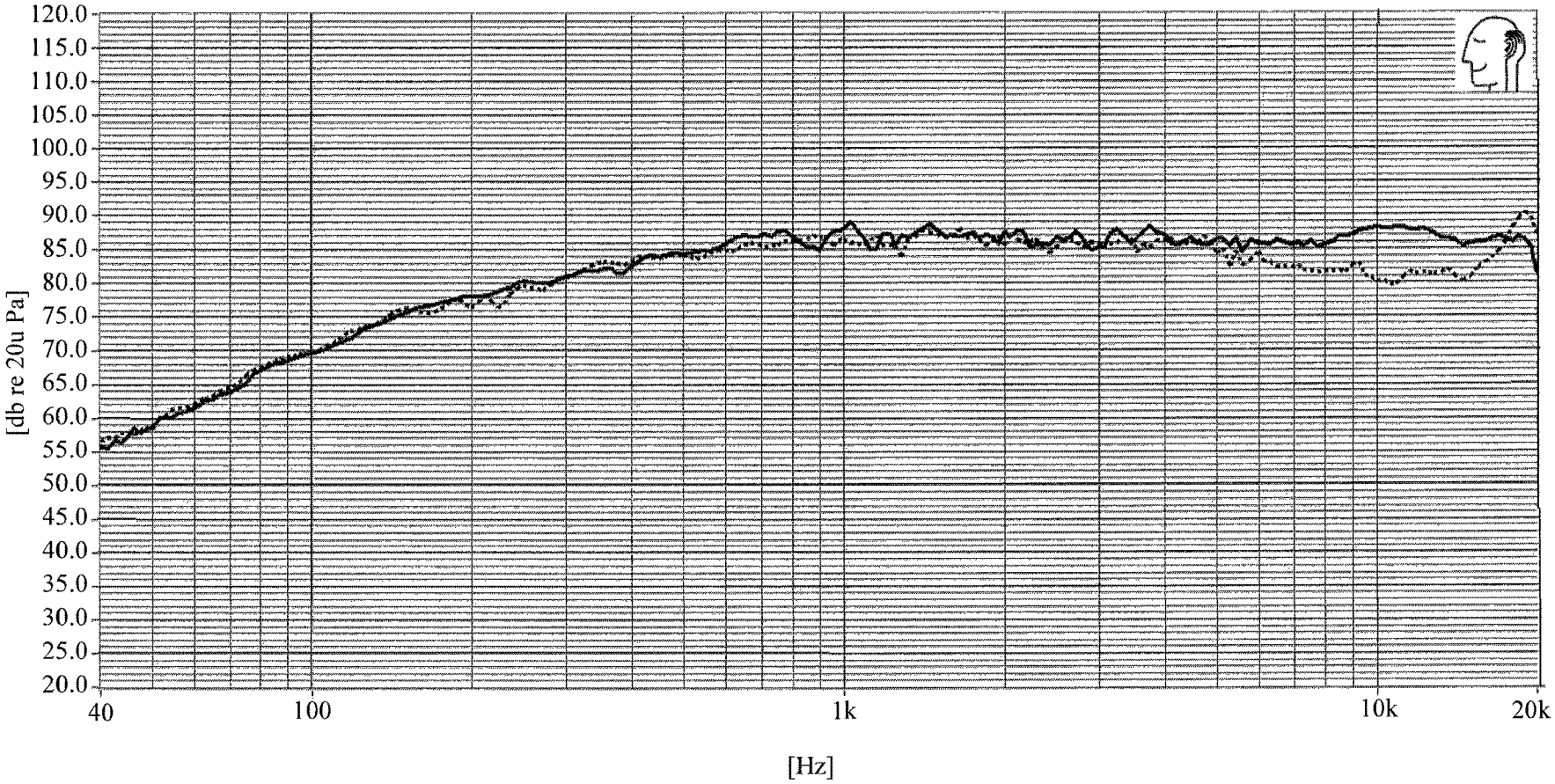
FIG. 6 is a curve showing the frequency response of a full-range speaker with phase plate according to an exemplary embodiment of the invention; and a full-range speaker without phase plate.

FIG. 6 is a curve showing the frequency response of a full-range speaker with phase plate according to an exemplary embodiment of the invention and a full-range speaker without a phase plate, wherein the dotted line represents the frequency response curve of the full-range speaker without phase plate added, and the solid line represents the frequency response curve of the full-range speaker with phase plate of the present embodiment. After comparing the frequency response curves of the two, it can be seen from the box in FIG. 6 that the frequency response curve of the speaker with phase plate of the present embodiment at the frequency of 6 kHz-18 kHz is obviously improved. Therefore, by adding a phase plate, the phase may be adjusted to prevent standing waves, and the frequency response characteristics of the full-range speaker may be effectively improved, so that the overall frequency response curve of the full-range speaker is effectively boosted from 6 kHz to 18 kHz, resulting in a smoother overall frequency response curve.

The above is only an example and description of the structure of the present invention, and the description thereof is more specific and detailed, but is not to be construed as limiting the scope of the present invention. It should be noted that a number of variations and modifications may be made by those skilled in the art without departing from the spirit and scope of the present invention. These obvious alternatives are within the scope of protection of the present invention.

The invention claimed is:

1. A full-range speaker with phase plate, comprising:

a speaker body;

a phase plate, the phase plate including a phase panel; and a bracket disposed above the speaker body, the bracket being adapted to the phase panel, wherein the phase panel is fixed above the bracket, and wherein opposite corners of the phase panel are provided with protruding support ribs, each of the support ribs meeting with each other.

2. The full-range speaker with phase plate according to claim 1, wherein the phase panel and the bracket are fixed by screwing.

3. The full-range speaker with phase plate according to claim 1, wherein the cross section of the support rib is curved.

4. The full-range speaker with phase plate according to claim 1, wherein the phase panel is square.

* * * * *